US005361919A

United States Patent [19]

Hull et al.

[11] Patent Number: 5,361,919

[45] Date of Patent: Nov. 8, 1994

[54] COMBINATION BOTTLE CAP AND CONSTRUCTION TOY

[76] Inventors: Harold L. Hull, 401 Canyon Way #43, Sparks, Nev. 89434; Jorge Montalva, 8616 Spruce LK. Cir., Las Vegas, Nev. 89117

[21] Appl. No.: 42,645

[22] Filed: Apr. 5, 1993

[51] Int. Cl.[5] ..... B65D 51/24

[52] U.S. Cl. ..... 215/228; 220/212; 220/380

[58] Field of Search ..... 215/228; 220/4.26, 4.27, 220/212, 376, 380; 446/71, 120, 121, 124, 125

[56] References Cited

U.S. PATENT DOCUMENTS

| | | | |
|---|---|---|---|
| 3,009,594 | 11/1961 | Anson | 215/48 |
| 3,713,247 | 1/1973 | Parrilla | 446/71 |
| 4,141,461 | 2/1979 | La Chance | 220/253 |
| 4,202,456 | 5/1980 | Silber | 215/228 |
| 4,379,578 | 4/1983 | Schuler | 294/31.2 |
| 4,583,651 | 4/1986 | Ostberg | 215/228 |
| 4,660,876 | 4/1987 | Weldin | 294/33 |
| 4,666,197 | 5/1987 | Watson | 294/31.2 |
| 4,764,143 | 8/1988 | Gat et al. | 446/120 X |
| 4,768,403 | 9/1988 | Bar-Noy | 81/3.15 |
| 4,842,158 | 6/1989 | Reyes, Jr. | 220/94 R |
| 4,896,913 | 1/1990 | Kennedy | 294/31.2 |
| 5,104,125 | 4/1992 | Wilson | 446/120 X |

*Primary Examiner*—Sue A. Weaver

[57] ABSTRACT

Disclosed is a combination bottle cap and stackable toy which allows the bottle caps to be accumulated and then affixed together to form various shapes and configurations, thus providing an incentive for the user to purchase a bottle having the stackable cap.

2 Claims, 1 Drawing Sheet

FIG 1
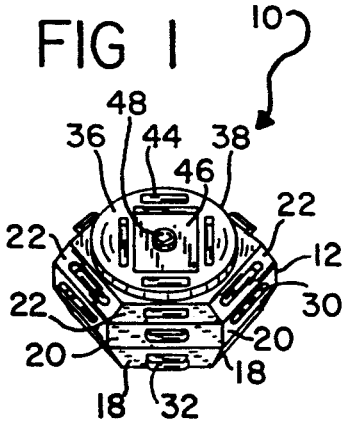
FIG 2
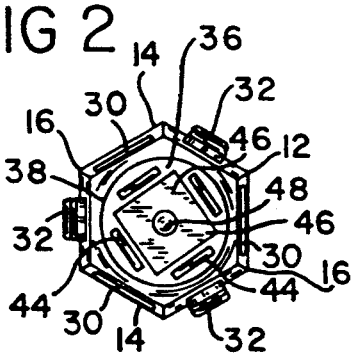
FIG 3
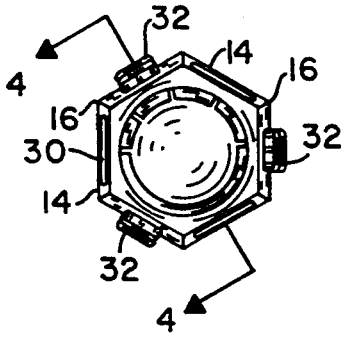
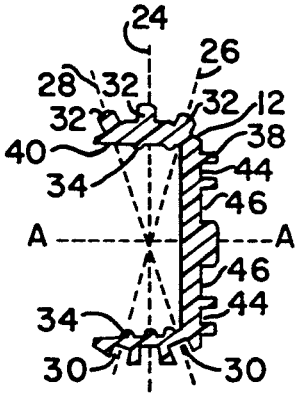
FIG 4
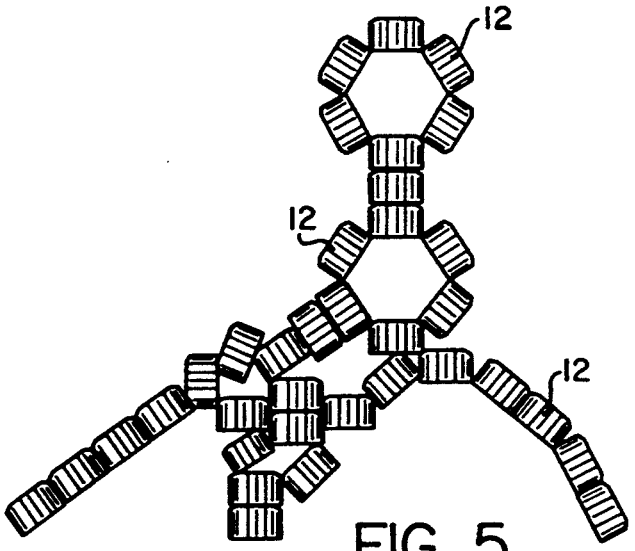
FIG 5

COMBINATION BOTTLE CAP AND CONSTRUCTION TOY

FIELD OF THE INVENTION

The present invention relates to bottle caps and more particularly to a bottle cap which is also a toy. The bottle cap being of a shape and size so as to allow for mating between two or more caps to form multiple variations of objects.

BACKGROUND OF THE INVENTION

In the past, attempts have been made to provide a bottle cap which has unique and duel features, such as the novelty bottle cap-toy-top of U.S. Pat. No. 4,583,651 in which they teach a bottle cap which when not in use as a cap, may be used as a toy-top. Also, U.S. Pat. No. 3,009,594 provides a bottle cap which is used as a cap but simultaneously may be used as a retaining element to secure an inflated balloon for a humorous or decorative effect.

These bottle caps are complete and functional for their intended use, however, nowhere in the prior art, nor in these references, do they provide a bottle cap which is disclosed by the present invention, which is a combination bottle cap and stackable toy, and due to its unique shape and size provides not only a cap but when not used as a cap can be used to build multiple variations of objects (similar to building blocks) when two or more caps are mated together.

SUMMARY OF THE INVENTION

It is therefore a primary object to provide a novel bottle cap which is a combination cap and stackable toy.

A further object is to provide a bottle cap which is of a unique shape and size so as to allow for mating between two or more caps.

Still another object is to provide the bottle cap with removable attachable means between the bottle caps.

Yet another object is to provide the bottle cap with threads, which cooperate with the threads of a bottle neck.

Other objects and advantages will become apparent when taken into consideration with the following drawings and specifications.

BRIEF DESCRIPTION OF THE DRAWINGS

FIG. 1, is a perspective view showing the preferred embodiment of the present invention.

FIG. 2, is a top view of the bottle cap.

FIG. 3, is a bottom view of the bottle cap.

FIG. 4, is a sectional view taken at 4—4 of FIG. 3.

FIG. 5, is a plan view showing one possible configuration of multiple bottle caps when mated.

DETAILED DESCRIPTION OF THE DRAWINGS

Referring now in detail to the drawings wherein like characters refer to like elements throughout the various drawings, 10 is an overview of bottle cap 12 which may be made of plastic by injection molding and may take the shape of a polygon. In the preferred embodiment the polygon takes the shape of a hexagon, thus forming a hexagonal object having six sides 14 and six angles 16 with each of the six sides 14 having 3 sets of surfaces 18, 20 and 22, respectively, with surface 20 being at substantially a 90 degree angle as shown by ghost line 24 to a line A—A drawn through the center of the bottle cap

12 as shown in FIG. 4, while surfaces 26 and 28, respectively, being at an angle less than 90 degrees are shown by ghost lines 26 and 28, respectively.

Each of the surfaces 18, 20 and 22, respectively, have indents 30 or detents 32 which are of a size and shape to form a mating friction fit and are staggered to form sets of 3 with every other one being an indent 30 or a detent 32.

The bottle cap 12 also has threads 34 on its interior which mate with threads on a bottle neck or the like (not shown) and the top surface 36 of the bottle cap 12 is formed by a circular protrusion 38 which also mates with the interior circular shape 40 of the bottom lip 42 of the bottle cap 12.

The top surface 36 also has indents 44 which mate with detents 32, with indent 46 being a relief and hub 48 being a support for the detents 32 when engaged in substantially a 90 degree angle with a second bottle cap 12.

It will now be noted that two caps may fit together in a number of ways as shown in FIG. 4, i.e., on top of each other, adjacent each other or at least two different angles to each other, giving an unlimited number of configurations possible.

It will now be seen that we have provided a novel bottle cap which is a combination cap and stackable toy.

We have also provided a bottle cap which is of a unique shape and size so as to allow for mating between two or more caps.

It will also be noted that we have provided a bottle cap with removable, attachable means between the bottle caps.

We have also provided a bottle cap having threads, which cooperate with the threads of a bottle neck.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described our invention, what we claim as new and wish to secure by letters patent is:

1. A bottle cap which can be affixed with bottle caps of the same construction and used as a stackable toy, said bottle cap comprising; an open end, 3aid open end having an interior circular shaped indent and means to affix said bottle cap to the neck of a bottle to provide a seal;

said cap including a substantially protruding flat top surface opposite said open end, said flat top surface being in the form of a circle and having multiple indents;

said cap being substantially in the shape of a polygon with multiple sides and multiple angles, said sides each having three sets of surfaces, said sets of surfaces being at different angles to each other and having alternating detents and indents; said indents and detents of said sets of surfaces and said indents of said flat top surface being of a size and shape to form a mating friction fit with corresponding indents and detents of a second cap of the same construction; the protruding flat top surface further being sized to mate with said interior circular shaped indent of said open end of a second cap of the same construction whereby, when multiples of said bottle caps are affixed to each other by said mating indents and detents, said affixed bottle caps take the form of various shapes of choice.

2. The bottle cap of claim 1 wherein said means to affix said cap to the neck of a bottle is in the form of threads.

* * * * *